US005245839A

United States Patent [19]

Chang et al.

[11] Patent Number: 5,245,839

[45] Date of Patent: Sep. 21, 1993

[54] ADSORPTION-TYPE REFRIGERANT RECOVERY APPARATUS

[75] Inventors: Michael C. H. Chang; Viung C. Mei; Chung Y. Yang; Yie Z. R. Hu, all of Hsinchu, Taiwan

[73] Assignee: Industrial Technology Research Institute, Hsinchu, Taiwan

[21] Appl. No.: 923,488

[22] Filed: Aug. 3, 1992

[51] Int. Cl.[5] ..... F25B 45/00

[52] U.S. Cl. ..... 62/292; 62/475

[58] Field of Search ..... 62/77, 85, 149, 292, 62/475

[56] References Cited

U.S. PATENT DOCUMENTS 4,441,330 4/1984 Lower et al. ..... 62/149

5,161,385 11/1992 Schumacher ..... 62/127

*Primary Examiner*—John M. Sollecito

*Attorney, Agent, or Firm*—Michael D. Bednarek

[57] ABSTRACT

An adsorption-type refrigerant recovery apparatus for a refrigeration and air conditioning system that has a connection unit, a refrigerant flow direction control device, a refrigerant adsorbing/desorbing device, a refrigerant/lubricant separating device, a condensation heat exchanging device, a drying/purging device, and a refrigerant reservoir. When the refrigerant enters the connection unit from the refrigeration and air conditioning system, the flow direction control device controls the refrigerant flowing through the adsorbing-/desorbing device so that the refrigerant absorbs part of the heat energy of the adsorbent and is thus vaporized. The vaporized refrigerant then enters the refrigerant-/lubricant separating device to separate the lubricant therein. The flow direction control device further controls the refrigerant entering the adsorbent container to allow the adsorbent to adsorb the refrigerant. When the adsorbent is saturated, the adsorbent is heated to desorb the refrigerant in a gaseous state. The flow direction control device then directs the refrigerant gas to enter the condensation heat exchanging device so that the refrigerant gas is condensed to a liquid. Finally, the drying/purging device dries and purifies the refrigerant liquid, and emits the non-condensable gas before the refrigerant liquid enters the refrigerant reservoir for storage.

6 Claims, 3 Drawing Sheets

ADSORPTION-TYPE REFRIGERANT RECOVERY APPARATUS

BACKGROUND OF THE INVENTION

The present invention relates generally to a refrigerant recovery apparatus for a refrigeration and air conditioning system, and particularly to an adsorption-type recovery apparatus which can recover gas, liquid, or gas-liquid-mixture refrigerant that have different properties but similar molecular dimensions.

The refrigerant recovery of the conventional refrigeration and air conditioning system utilizes a compressor to condense it to liquid for the recovery purpose. Since it cannot be ensured that the refrigerant entering the compressor is entirely vaporized, the liquid refrigerant may enter the compressor, frequently resulting in damage to the compressor. Even if a heater is arranged to entirely vaporize the refrigerant before it enters the compressor, the compressor still cannot be commonly utilized to recover all different kinds of refrigerant because it only suits certain specific refrigerant.

SUMMARY OF THE INVENTION

Accordingly, the primary object of the present invention is to provide a refrigerant recovery apparatus that can remove the gas, liquid, or gas-liquid-mixture refrigerant in the liquid state of normal temperature without a compressor.

Another object of the present invention is to provide an adsorption-type refrigerant recovery apparatus which utilizes the porosity of an adsorbent to adsorb and the refrigerant molecules for the purpose refrigerant recovery purpose.

Yet another object of the present invention is to provide an adsorption-type refrigerant recovery apparatus which utilizes an adsorbent to recover the refrigerant having different properties but similar molecular dimensions.

In accordance with the present invention an adsorption-type refrigerant recovery apparatus utilizes the porosity of an adsorbent, such as a molecular sieve, to adsorb the refrigerant molecules in its pores. The kinetic energy of the refrigerant molecules is reduced and converted into heat energy. By externally adding heat energy, the kinetic energy of the adsorbed refrigerant molecule is increased so that the refrigerant is desorbed from the adsorbent in the gaseous state. A part of the heat energy of the adsorbent is utilized to vaporize the liquid refrigerant in order to subsequently separate the lubricant within the refrigerant/lubricant separating device, and another part of the heat energy is removed by a heat radiating device. Therefore, the adsorption-type refrigerant recovery apparatus can recover gaseous, liquid, or gas-liquid-mixture refrigerant. Furthermore, the adsorbent does it not select for the kind of matter adsorbs, and can adsorb all kinds of refrigerant if their molecular dimensions are similar to the pore dimension of the adsorbent.

In regards to another aspect of the present invention, an adsorption-type refrigerant recovery apparatus, it is adapted to recover refrigerant from a refrigeration and air conditioning system into a refrigerant reservoir and comprises: a connection unit connected to and receiving the refrigerant from the refrigeration and air conditioning system; a refrigerant flow direction control device connected to the connection unit; at least one refrigerant adsorbing/desorbing device connected to the refrigerant flow direction control device; a refrigerant/lubricant separating device connected to the refrigerant flow direction control device; a condensation heat exchanging device connected to the refrigerant flow direction control device; and a drying/exhausting device connected between the condensation heat exchanging device and the refrigerant reservoir; wherein the refrigerant adsorbing/desorbing device includes an adsorbent container, an adsorbent located within the adsorbent container, a heater located within the adsorbent container, and a heat radiating device connected to the adsorbent container; and when the refrigerant is received by the connection unit from the refrigeration and air conditioning system, the refrigerant flow direction control device controls the refrigerant flowing through the adsorbent container of the refrigerant adsorbing/desorbing device so that the refrigerant absorbs part of the heat energy of the adsorbent and is thus vaporized. The vaporized refrigerant then enters the refrigerant/lubricant separating device to separate the lubricant therein; the refrigerant flow direction control device further controls the refrigerant entering the adsorbent container so as to let the adsorbent adsorb the refrigerant. Part of the heat energy generated during the adsorption step is removed in the previous refrigerant vaporization step and the remainder is removed by the heat radiating device. When the adsorbent is saturated, the heater heats the adsorbent to desorb the refrigerant in gaseous state; the refrigerant flow direction control device then controls the refrigerant gas entering the condensation heat exchanging device so that the refrigerant gas is condensed to liquid. Finally, the drying/exhausting device drys and purifies the refrigerant liquid, and emits the noncondensable gas before the refrigerant liquid enters the refrigerant reservoir.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
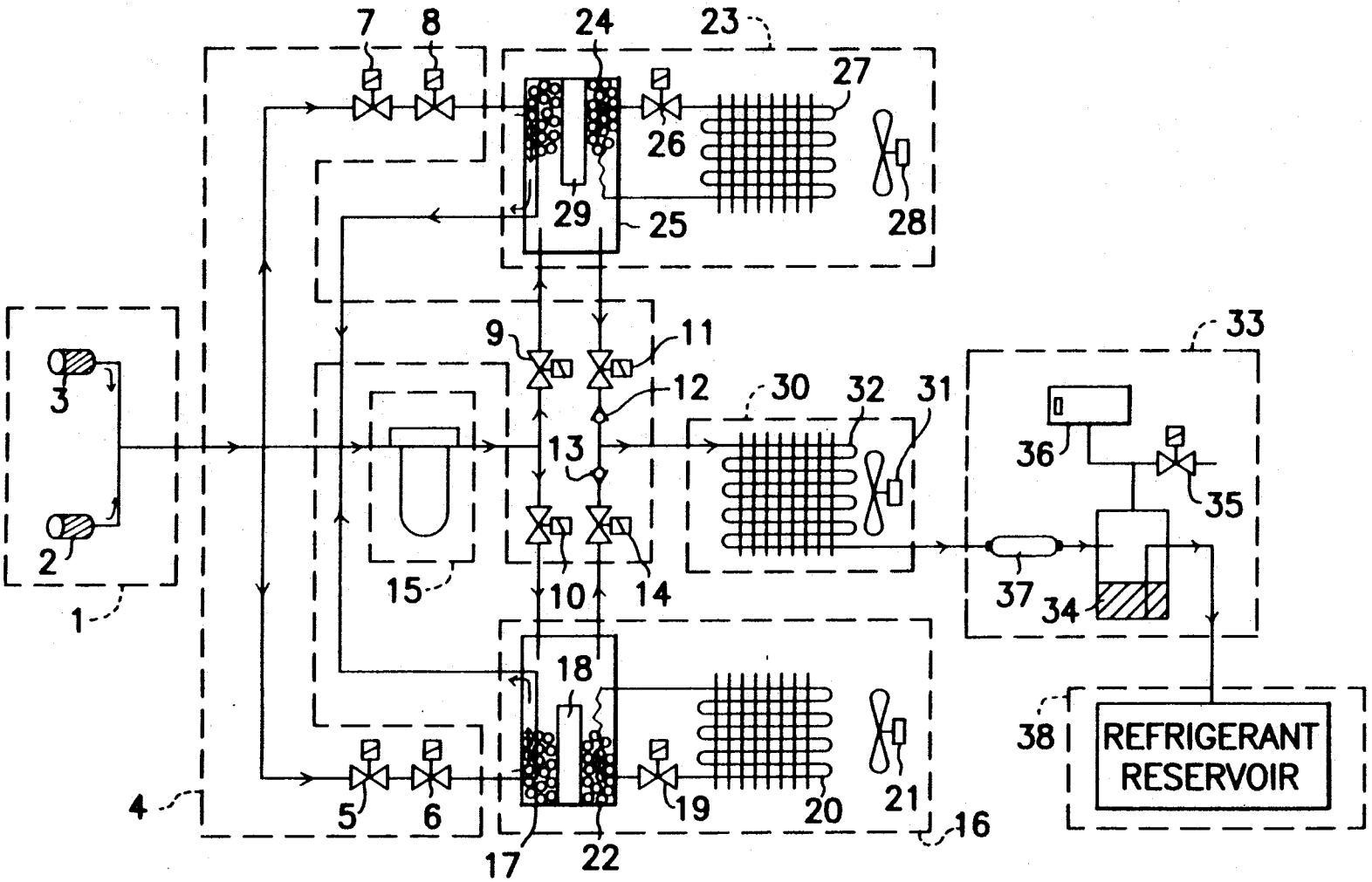
FIG. 1 is a schematic block diagram of an adsorption-type refrigerant recovery apparatus in accordance with the first preferred embodiment of the present invention.

FIG. 1 shows an adsorption-type refrigerant recovery apparatus according to the first embodiment of the present invention. The recovery apparatus comprises a connection unit 1, a refrigerant flow direction control device 4, a refrigerant/lubricant separating device 15, two refrigerant adsorbing/desorbing devices 16 and 23, a condensation heat exchanging device 30, a drying/exhausting device 33, a refrigerant reservoir 38, and a plurality of refrigerant pipings indicated by solid lines. The arrows in FIG. 1 indicate the flow directions of the refrigerant. The connection unit 1 is comprised of a low-pressure hose 2 and a high-pressure hose 3 respectively connecting to the low-pressure and high-pressure service units (not shown) of the refrigeration and air conditioning system. The refrigerant flow direction control device 4 is comprised of a plurality of refrigerant pipes, a plurality of electromagnetic valves 5, 6, 7, 8, 9, 10, 11, and 14, and two check valves 12 and 13. The connections between the parts of the refrigerant flow direction control device 4 are clearly shown in FIG. 1, so further description is deemed unnecessary. The flow direction control device 4 is utilized to control the refrigerant flowing through the refrigerant adsorbing-/desorbing devices 16 and 23, flowing from the refrigerant/lubricant separating device 15 into the adsorbing/desorbing devices 16 and 23, and flowing from the adsorbing/desorbing devices 16 and 23 into the condensation heat exchanging device 30. The refrigerant/lubricant separating device 15 has one end the adsorbing-/desorbing devices 16 and 23 and the other end connected to the adsorbing/desorbing devices 16 and 23 via the flow direction control device 4, as may be seen from FIG. 1. Each refrigerant adsorbing/desorbing device 16 (23) includes a molecular sieve 17 (24), a molecular sieve container 22 (25), a heater 18 (29), an electromagnetic valve 19 (26), a heat-pipe heat exchanger 20 (27), and a fan 21 (28). The heater 18 (29) is located within the molecular sieve container 22 (25) in order to heat the molecular sieve 17 (24) within the container 22 (25). The pipe of the heat-pipe heat exchanger 20 (27) passes through the molecular sieve container 22 (25) in order to cool the molecular sieve 17 (24). The condensation heat exchanging device 30 is primarily comprised of an air/refrigerant heat exchanger 32 and fan 31. One end of the condensation heat exchanging device 30 is connected to the molecular sieve containers 22 and 25 of the refrigerant adsorbing/desorbing devices 16 and 23 via the flow direction control device 4, and the other end is connected to the drying/purging device 33. The drying/purging device 33 includes a dryer 37, a liquid reservoir 34, an electromagnetic valve 35, and an exhaust pipe 36. One end of the drying/purging device 33 is connected to the condensation heat exchanging device 30 and the other end is connected to the refrigerant reservoir 38. Although two refrigerant adsorbing-/desorbing devices are shown in the embodiments of the embodiments of the present invention, it should be understood that one refrigerant adsorbing/desorbing device actually sufficient to achieve the purpose of the present invention.

When the refrigerant flows from the refrigeration and air conditioning system into the high-pressure hose 2 of the connection unit 1, it is controlled by the refrigerant flow direction control device 4 to flow through the electromagnetic valves 5, 6, 7, and 8, and the molecular sieve containers 22 and 25 of the refrigerant adsorbing-/desorbing devices 16 and 23. In this manner, the refrigerant is entirely vaporized by the heat exchange with the molecular sieves 17 and 24 via the pipes. The gas refrigerant is directed by the flow direction control device 4 in to the molecular sieve containers 22 and 25 within the refrigerant adsorbing/desorbing devices 16 and 23. The refrigerant molecule is then heat energy generated while the molecular sieves 17 and 24. Part of the heat energy generated while the molecular sieves adsorb the refrigerant is removed when the liquid refrigerant is vaporized in the above-mentioned step, and most of the heat energy is removed by the heat-pipe heat exchangers 20 and 27 by the fans 21 and 28 which cause air convection to radiate the heat energy. When the molecular sieves 17 and 24 are saturated, the heaters 18 and 19 heat the molecular sieves to desorb the refrigerant in a gaseous state. The desorbed refrigerant is then directed by the flow direction control device 4 is to the condensation heat exchanging device 30 so that the refrigerant is condensed to a liquid of normal temperature. The condensed refrigerant liquid then enters the drying/purging device 33. The water in the refrigerant is removed by the dryer 37 before the refrigerant enters the liquid reservoir 34, and non-condensable gas is removed through the exhaust pipe 36. Finally, the purified refrigerant enters the refrigerant reservoir 38 for storage.

Figure 2:
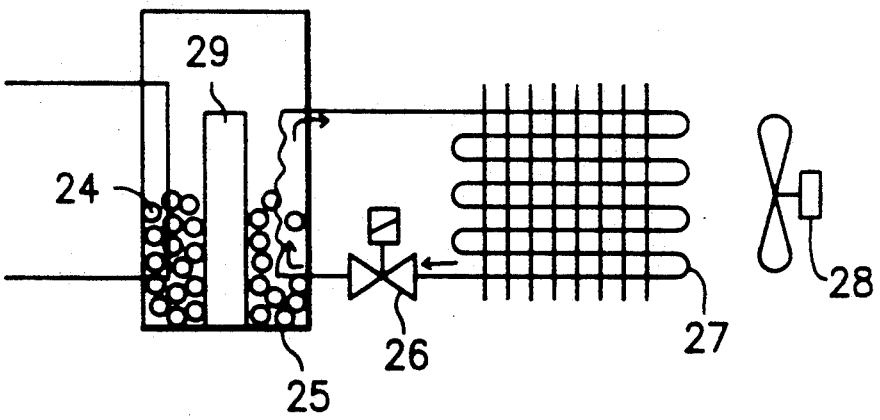
FIG. 2 is a schematic diagram of the heat-pipe heat exchanger shown in FIG. 1.

FIG. 2 shows the operation flow chart of the refrigerant adsorbing/desorbing device 23 (or 16) shown in FIG. 1. The arrows in FIG. 2 indicate the flow directions of the working fluid (a proper refrigerant can be selected) within the heat-pipe heat exchanger 27. The working fluid is condensed to a liquid at the condensation side of the heat-pipe heat exchanger 27, and then enters the evaporation side of the heat-pipe heat exchanger 27 within the molecular sieve container 25 via the electrolmagnetic valve 26 in order to achieve heat exchange with the molecular sieve 24. The working fluid absorbs the heat energy of the molecular sieve 24, and is thus vaporized. The vaporized working fluid leaves the molecular sieve container 25 and enters the condensation side of the heat-pipe heat exchanger 27 to be condensed back in to a liquid. In the adsorption step, the electromagnetic valve 26 is open, and the working fluid in the heat-pipe heat exchanger 27 repeats the vaporization and condensation steps to remove the heat energy generated during the adsorption of the refrigerant. In the desorbing step, the electromagnetic valve 26 is closed, and the working fluid in the heat-pipe heat exchanger 27 is accumulated at the condensation side to terminate the heat radiation function.

Figure 3:
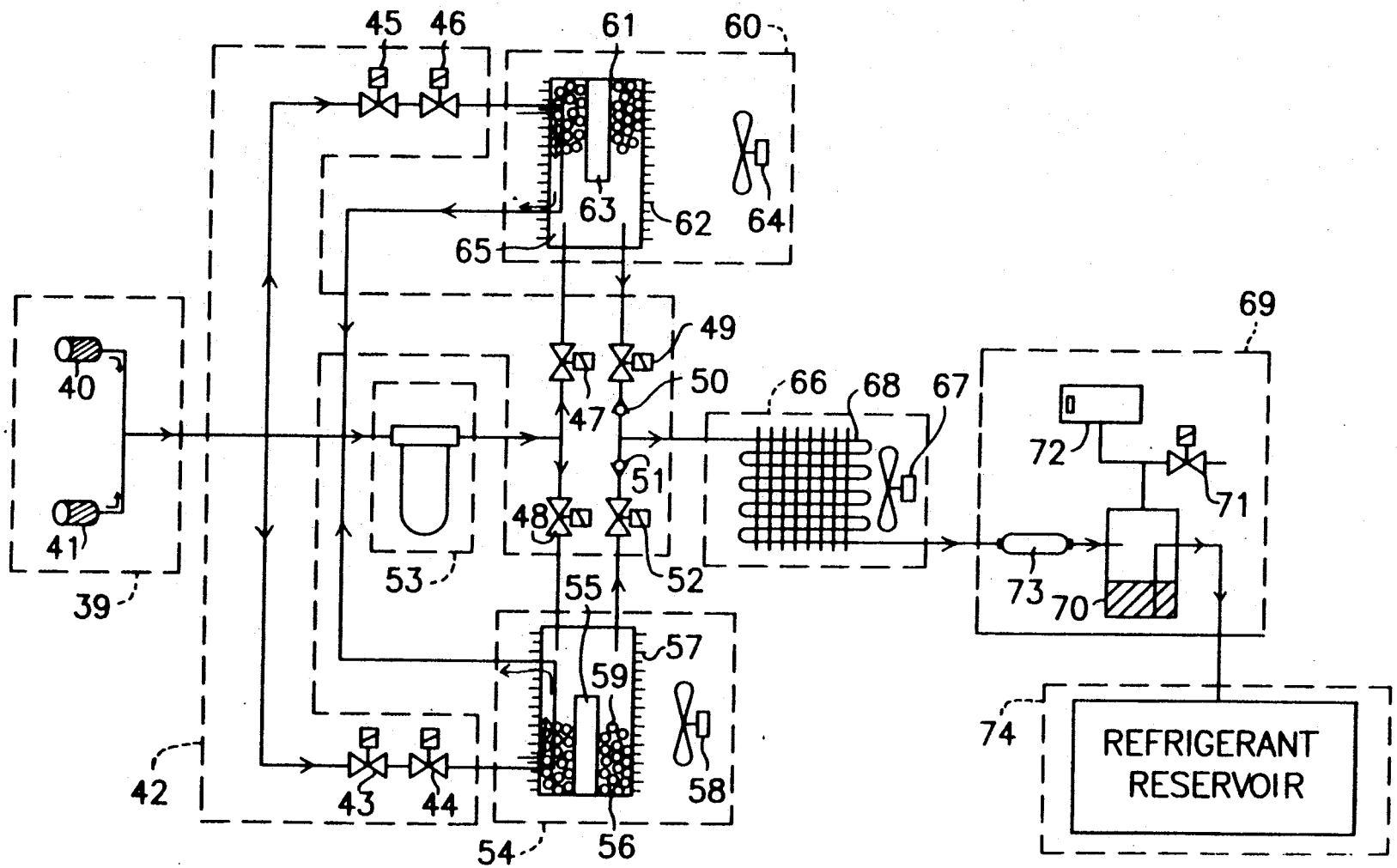
FIG. 3 is a schematic block diagram of another adsorption-type refrigerant recovery apparatus in accordance with a second preferred embodiment of the present invention.

FIG. 3 shows another adsorption-type refrigerant recovery apparatus according to a second embodiment of the present invention. The recovery apparatus comprises a connection unit 39, a refrigerant/lubricant separating device 53, two refrigerant adsorbing/desorbing devices 54 and 60, a condensation heat exchanging device 66, a drying/purging device 69, a refrigerant reservoir 74, and a plurality of refrigerant pipes indicated in FIG. 3 by solid lines. The arrows shown in FIG. 3 indicate the flow directions of the refrigerant. The connection unit 39 is comprised of a low-pressure hose 41 and a high-pressure hose 40 respectively connecting to the low-pressure and high-pressure service units (not shown) of the refrigeration and air conditioning system. The refrigerant flow direction control device 42 is comprised of a plurality of refrigerant pipes, a plurality of electromagnetic valves 43, 44, 45, 46, 47, 48, 49, and 52 and two check valves 50 and 51. The connections between all the parts of the refrigerant flow direction control device 42 are clearly shown in FIG. 3, so further description is deemed unnecessary. The flow direction control device 42 is utilized to control the refrigerant flowing through the refrigerant adsorbing/desorbing devices 54 and 60, flowing from the refrigerant/lubricant separating device 53 via the adsorbing/desorbing devices 54 and 60 into the condensation heat exchanging device 66. The refrigerant/lubricant separating device 53 has one end connected to the flowing direction control device 42 via the adsorbing/desorbing devices 54 and 60 and the other end connected to the adsorbing/desorbing devices 54 and 60 via the flowing direction control device 42, as can be seen in FIG. 3. Each refrigerant adsorbing/desorbing device 54(60) includes a molecular sieve 59 (61), a molecular sieve container 56 (65), a heater 55 (63), a plurality of fins 57 (62), and a fan 58 (64). The heater 55 (63) is located within the molecular sieve container 56 (65) in order to heat the molecular sieve 59 (61). The fins 57 (62) are arranged around the outer periphery of the molecular sieve container 56 (65). The condensation heat exchanging device 66 is primarily comprised of an air/refrigerant heat exchanger 68 and a fan 67. One end of the condensation heat exchanging device 66 is connected to the molecular sieve containers 56 and 65 of the refrigerant adsorbing/desorbing devices 54 and 60 via the flow direction control device 42 and the other end is connected to the drying/purging device 69. The drying-/purging device 69 includes a dryer 73, a liquid reservoir 70, an electromagnetic valve 71, and an exhaust pipe 72. One end of the drying/purging device 69 is connected to the condensation heat exchanging device 66, and the other end is connected to the refrigerant reservoir 74.

When the refrigerant flows from the refrigeration and air conditioning system into the high-pressure hose 40 and the low-pressure hose 41 of the connection unit 39, it is controlled by the refrigerant flow direction control device 42 to flow through the electromagnetic valves 43, 44, 45, and 46 the molecular sieve containers 56 and 65 within the refrigerant adsorbing/desorbing devices 54 and 60. In this manner, the refrigerant is entirely vaporized due to heat exchange with the molecular sieves 59 and 61 via the pipes. The vaporized refrigerant enters the refrigerant/lubricant mixed in the refrigerant/lubricant separating device 53 to the lubricant mixed in the refrigerant pipe. The gas refrigerant is then directed by the flow direction control device 42 into the molecular sieve containers 56 and 65 within the refrigerant adsorbing/desorbing devices 54 and 60. The refrigerant molecule is adsorbed by the molecular sieves 59 and 61. Part of the heat energy generated while the molecular sieves adsorb the refrigerant is removed when the liquid refrigerant is vaporized in the above-mentioned step, and the greater part of the heat energy is removed by the fins 57 and 62 around the molecular sieve containers 56 and 65 in a manner whereby the fans 58 and 64 cause air convection to readier the heat energy. When the molecular sieves 59 and 61 are saturated, the heaters 55 and 63 heat the molecular sieves to desorb the refrigerant. The desorbed refrigerant is then controlled by the flow direction control device 42 to enter the condensation heat exchanging device 66 so that the refrigerant is condensed to a liquid of normal temperature. The condensed refrigerant liquid then enters the drying/purging device 69. The water in the refrigerant is removed by the dryer 73 before the refrigerant enters the liquid reservoir 70, and non-condensable gas is removed through the exhaust pipe 72. Finally, the purified refrigerant enters the refrigerant reservoir 74 for storage.

Figure 4:
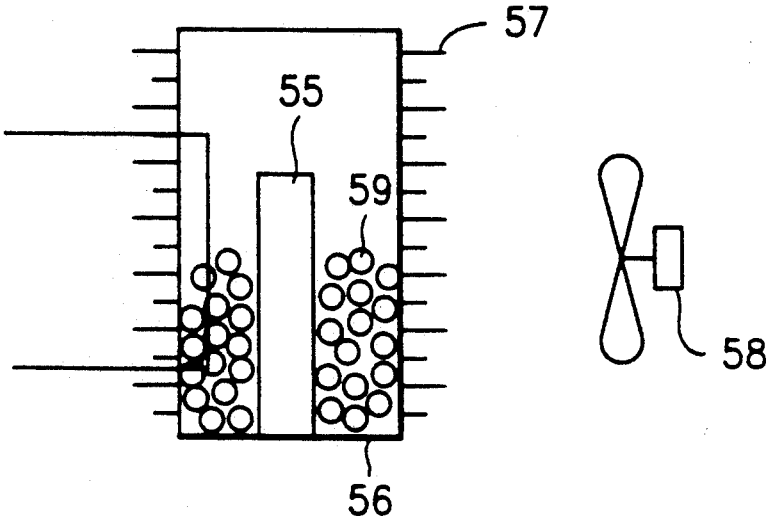
FIG. 4 is a schematic diagram of the refrigerant adsorption and desorbing device shown in FIG. 3, and includes a plurality of fins and a fan to achieve the heat exchange.

FIG. 4 shows a structural diagram of the molecular sieve container of FIG. 3 incorporating a plurality of fins and a fan. The heat energy generated while the molecular sieve 59 (or 61) adsorbs the refrigerant is removed by the fins 57 in a manner whereby the fan 58 causes air convection to radiate the heat energy.

According to the aforesaid embodiments, it should be evident that the present invention does not require a compressor and mainly utilizes the porosity of an adsorbent, such as a molecular sieve, to recover the gas, liquid, or gas-liquid-mixture refrigerant in a refrigeration and air conditioning system. The present invention overcomes the drawbacks that have long existed in the conventional compressor recovery method. For example, conventionally, the refrigerant has to be vaporized entirely before entering the compressor, and the compressor is only suitable for certain specific cooling media. The present invention can recover cooling media that have different properties but similar molecular dimensions.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An adsorption-type refrigerant recovery apparatus adapted to recover a refrigerant from a refrigeration and air conditioning system into a refrigerant reservoir that comprises: a connection unit connected to and receiving said refrigerant from said refrigeration and air conditioning system; a refrigerant flow direction control device connected to said connection unit to receive said refrigerant; at least one refrigerant adsorbing-/desorbing device connected to said refrigerant flow direction control device; a refrigerant/lubricant separating device connected to said refrigerant flow direction control device; a condensation heat exchanging device connected to said refrigerant flow direction control device; and a drying/purging device connected between said condensation heat exchanging device and said refrigerant reservoir; wherein said refrigerant adsorbing/desorbing device includes an adsorbent container, an adsorbent located within said adsorbent container, a heater located within said adsorbent container, and a heat radiating device connected to said adsorbent container; and said refrigerant is received by said connection unit from said refrigeration and air conditioning system, said refrigerant flow direction control device is comprised of: means to control said refrigerant to flow through said adsorbent container of said refrigerant absorbing/desorbing device so that the refrigerant absorbs part of the heat energy of said adsorbent and is thus vaporized; means to cause the vaporized refrigerant to enter said refrigerant/lubricant to separate the said lubricant; means to control said refrigerant entering said adsorbent container to allow said adsorbent to adsorb said refrigerant with part of the heat energy generated during the adsorption step removed in the previous refrigerant vaporization step and the other part of the heat energy removed by said heat radiating device; when said adsorbent is saturated, said heater heats said adsorbent to desorb said refrigerant in a gaseous state; and means to cause said refrigerant gas to enter said condensation heat exchanging device so that said refrigerant gas is condensed to a liquid; finally, said drying/purging device drys and purifies said refrigerant liquid, and emits the non-condensable gas before said refrigerant liquid enters said refrigerant reservoir.

2. The adsorption-type refrigerant recovery apparatus as claimed in claim 1, wherein said adsorbent is a molecular sieve.

3. The adsorption-type refrigerant recovery apparatus as claimed in claim 1, wherein said heat radiating device of said refrigerant adsorbing/desorbing device is a heat-pipe heat exchanger.

4. The adsorption-type refrigerant recovery apparatus as claimed in claim 2, wherein said heat radiating device of said refrigerant adsorbing/desorbing device is a heat-pipe heat exchanger.

5. The adsorption-type refrigerant recovery apparatus as claimed in claim 1, wherein said heat radiating device of said refrigerant adsorbing/desorbing device includes a plurality of fins arranged around the outer periphery of said adsorbent container, and a fan causing the air convection to in crease the heat radiation effect of said fins.

6. The adsorption-type refrigerant recovery apparatus as claimed in claim 2, wherein said heat radiating device of said refrigerant adsorbing/desorbing device includes a plurality of fins arranged around the outer periphery of said adsorbent container, and a fan causing the air convection to increase the heat radiation effect of said fins.

* * * * *